US008262470B1

(12) United States Patent
Haberkorn

(10) Patent No.: US 8,262,470 B1
(45) Date of Patent: Sep. 11, 2012

(54) MULTIPLE PULL SINGLE TOKEN SLOT MACHINE AND METHOD THEREFOR

(76) Inventor: Steve Haberkorn, Las Vegas, NV (US)

( * ) Notice: Subject to any disclaimer, the term of this patent is extended or adjusted under 35 U.S.C. 154(b) by 0 days.

(21) Appl. No.: 13/206,370

(22) Filed: Aug. 9, 2011

(51) Int. Cl.
*A63F 9/24* (2006.01)

(52) U.S. Cl. ..... 463/25; 463/30

(58) Field of Classification Search ..... 463/16, 463/20–25, 30–31; 273/292, 138.1
See application file for complete search history.

(56) References Cited

U.S. PATENT DOCUMENTS 7,900,828 B2 * 3/2011 Sheaffer ..... 235/380
7,934,990 B2 * 5/2011 Walker et al. ..... 463/25
8,021,229 B2 * 9/2011 Walker et al. ..... 463/25
2008/0272541 A1 * 11/2008 Walker et al. ..... 273/139
2009/0054149 A1 * 2/2009 Brosnan et al. ..... 463/42

* cited by examiner

*Primary Examiner* — Masud Ahmed
(74) *Attorney, Agent, or Firm* — Weiss & Moy, P.C.; Jeffrey D. Moy

(57) ABSTRACT

A slot machine has a wager receiving device to determine what currency is inserted into the slot machine. A processor is coupled to the wager receiving device. The processor executes program instructions causing the processor to: receive signals from the wager receiving device of the currency inserted into the slot machine; calculating a number of credits based on the currency inserted into the slot machine; and providing one of multiple credits for each paid credit or multiple plays of the slot machine per credit paid regardless of outcome of a previous play.

15 Claims, 2 Drawing Sheets

MULTIPLE PULL SINGLE TOKEN SLOT MACHINE AND METHOD THEREFOR

BACKGROUND

Embodiments of this disclosure relate generally to slot machines, and more particularly, to a slot machine that allows for multiple pulls of the slot machine on a single token regardless if the first pull produces a winning combination and or bonus combination.

Slot machines are casino gambling machines which may have three or more reels which spin when a button is pushed or a lever is pulled. Slot machines generally have a currency detector. The currency detector validates the coin or currency (hereinafter currency) placed in the slot machine and provides the proper amount of credits (i.e. pulls) for the currency inserted. Presently, slot machines provide one credit and hence one pull per currency indicated on the machine. For example, if the slot machine is a $1.00 slot machine, the slot machine provides one credit and hence one pull for each dollar inserted into the slot machine.

In general, a player receives one pull for each credit. There are some slot machines which allow for a second pull. However, in prior art slot machines, a second pull is only allowed if the reels on the slot show a winning combination and or a bonus combination.

Therefore, it would be desirable to provide a system and method that overcomes the above problems.

SUMMARY

A slot machine has a wager receiving device to determine what currency is inserted into the slot machine. A processor is coupled to the wager receiving device. The processor executes program instructions causing the processor to: receive signals from the wager receiving device of the currency inserted into the slot machine; calculating a number of credits based on the currency inserted into the slot machine; and providing one of multiple credits for each paid credit or multiple plays of the slot machine per credit paid regardless of outcome of a previous play.

A slot machine has a wager receiving device to determine what currency is inserted into the slot machine. A processor is coupled to the wager receiving device. The processor executes program instructions causing the processor to receive signals from the wager receiving device of the currency inserted into the slot machine; calculating a number of credits based on the currency inserted into the slot machine; and providing multiple credits for each paid credit.

A slot machine has a wager receiving device to determine what currency is inserted into the slot machine. A processor is coupled to the wager receiving device. The processor executes program instructions causing the processor to: receive signals from the wager receiving device of the currency inserted into the slot machine; calculating a number of credits based on the currency inserted into the slot machine; and providing multiple plays of the slot machine per credit paid regardless of outcome of a previous play.

The features, functions, and advantages can be achieved independently in various embodiments of the disclosure or may be combined in yet other embodiments.

BRIEF DESCRIPTION OF THE DRAWINGS

Embodiments of the disclosure will become more fully understood from the detailed description and the accompanying drawings, wherein.

Common reference numerals are used throughout the drawings and detailed description to indicate like elements.

DETAILED DESCRIPTION

Figure 1:
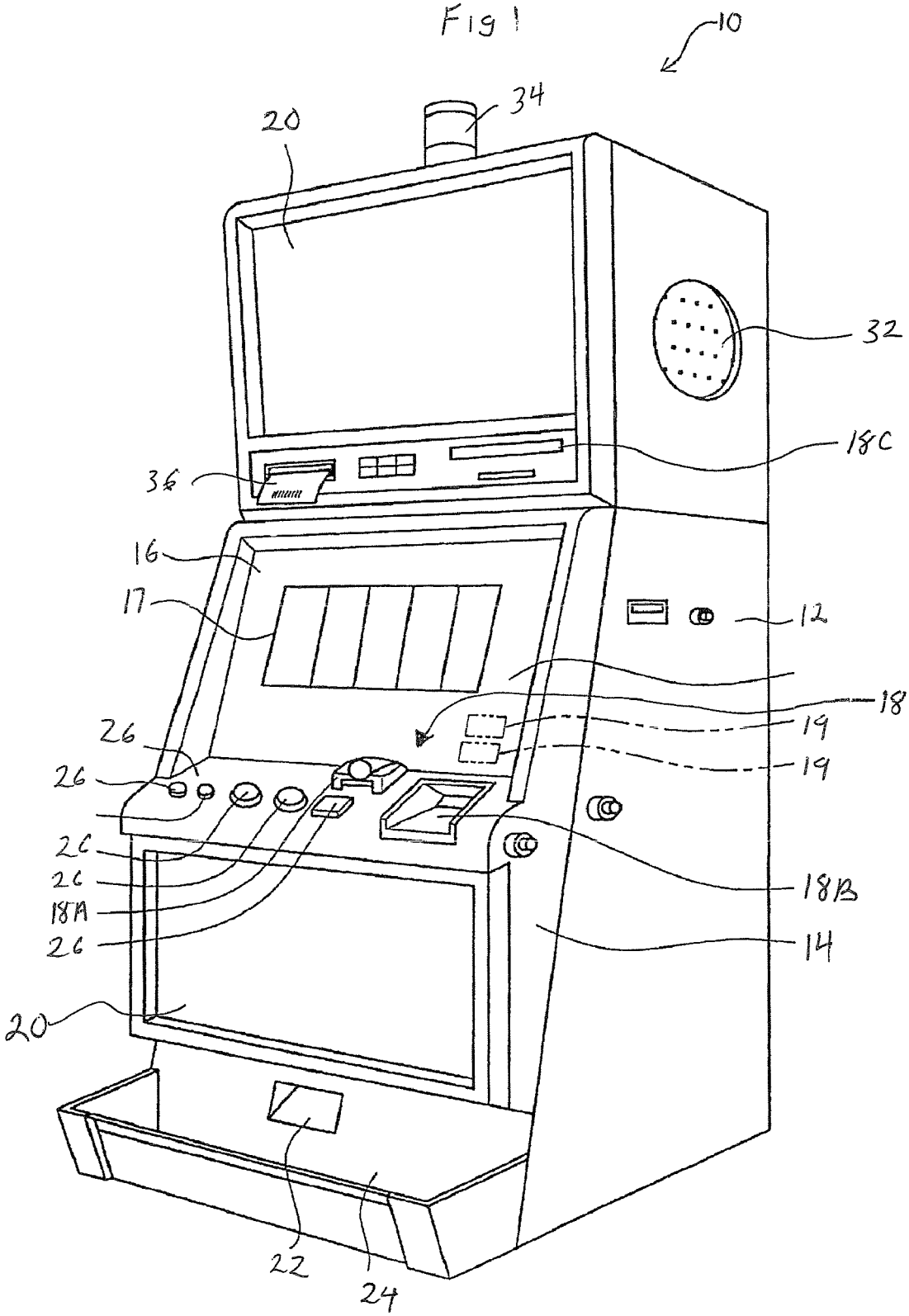
FIG. 1 is a simplified block diagram of a slot machine of the present invention.

Referring to FIG. 1, a slot machine 10 of the present invention is shown. The slot machine 10 may have a housing 12. The housing 12 maybe used to store and protect the internal circuitry of the slot machine 10.

A front panel 14 of the housing 10 may have a window 16. The window 16 may be used to show the playing area of the slot machine 10. The playing area may be a plurality of reels 17 as shown in FIG. 1. Alternatively, the playing area may be a video screen or the like.

One or more game information displays 19 may be located on the front panel 14. The game information displays 19 may be used to show the number of credits available, how many credits are being played, and the like. The listing of the above is given as examples and should not be seen in a limiting manner.

The front panel 14 may have a currency collector 18. The currency collector 18 may be used to insert currency in to the slot machine 10. The currency collector 18 may be a coin input 18A, or a paper currency collector 18B. Other types of currency collectors 18 may be used without departing from the spirit and scope of the present invention. For example, a card reading device may be used which may be able to read, a credit card, debit card, casino player' card and the like.

One or more display panels 20 may be formed in the front panel 14. The display panels 20 may be illuminate panels, video screens, or the like. The display panels 20 may be used to show different information about the slot machine 10 and or to attract individuals to the slot machine 10 to play. The display panels 20 may show a name of the slot machine, the payout for the slot machine, directions on how to play the slot machine, and the like. The above listing of the information which may be shown on the display panels 20 is given as an example and should not be seen in a limiting manner.

The front panel 14 may further have a currency outlet 22 and a collection tray 24. The currency outlet 22 may be used to dispense winnings from the slot machine 10. The collection tray 24 may be used to collect all the winnings that may be dispensed from the slot machine 10.

The front panel 14 may have a plurality of input devices 26. The input devices 26 may be used to activate and rotate the plurality of reels 17, play a set amount of credits, cash-out, and the like. The above are given as examples. The input devices 26 may serve other features without departing from the spirit and scope of the present invention. The slot machine 10 may also have a lever 28 located on a side panel 30. The lever 28 may also be used to activate and rotate the plurality of reels 17.

The slot machine 10 may have a plurality of other features. For example, the slot machine may have one or more speakers 32, a light indicator 34 to signal that help is needed or that a bonus payout has been won, a ticket dispenser 36 for dispensing printed tickets of credits, and the like.

Figure 2:
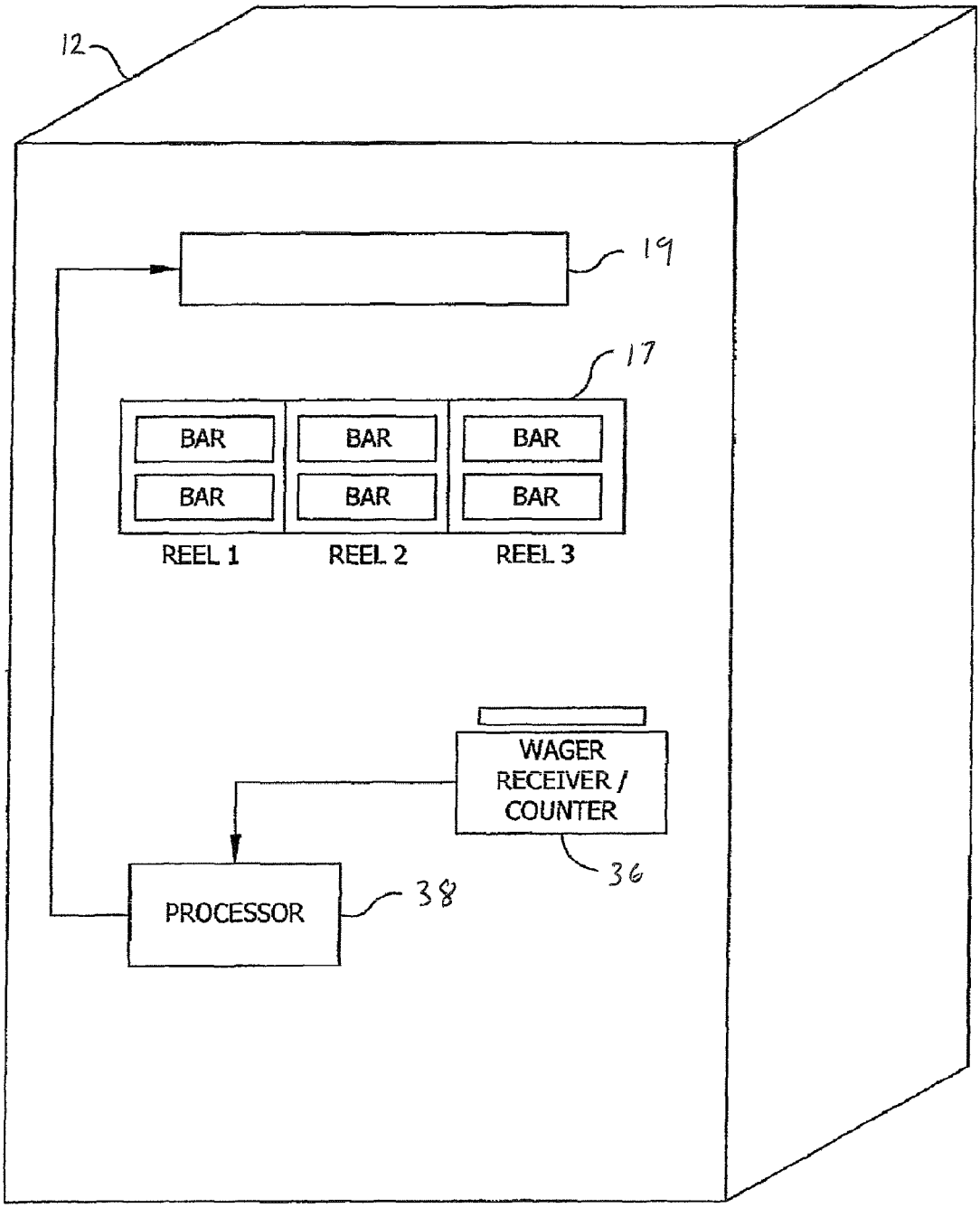
FIG. 2 is a flow chart showing operation of the slot machine shown in FIG. 1.

Referring now to FIG. 2, a simplified block diagram of a portion of the circuitry of the slot machine 10 is shown. The slot machine 10 may have a wager receiver/counter device 36. The wager receiver/counter device 36 receives any coins, paper currency, and or casino/credit card inserted into the currency collector 18. The wager receiver/counter device 36 determines what was inserted into the currency collector 18 and sends this information to a processor 38. The processor 38 will then provide the proper amount of credits for playing the slot machine. The processor 38 may be coupled to one or more of the game information displays 19. The game information displays 19 may show the number of credits available, the number of credits being played, and the like. The processor 38 may further be programmed to control operation of the slot machine. Hence, the processor may be used to control the operation of the window 16 to show the playing area of the slot machine 10. Thus, the processor 38 may be used to rotate and control the plurality of reels 17 and or video reels in the window 16.

In accordance with one embodiment, the processor 38 may provide multiple credits for each paid credit. For example, if the slot machine is a $1.00 slot machine, for each dollar paid, the processor 38 may provide 2 credits or more. Thus, a player may be given an option of playing additional rounds for a single credit paid or playing multiple credits for a single credit paid. In the above example, the player may have two plays/pulls for a single credit paid or alternatively, play two credits on a single play/pull.

In accordance with one embodiment, the player may two plays/pulls for a single credit paid. In this embodiment, the game information displays 19 may show the number of credits and also how many pulls per credit. For example, if the slot machine is a $1.00 slot machine, for each dollar paid, the processor 38 may provide 2 or more pulls. In this embodiment, the player is not given additional credits. Each player is given one credit per the designated payment, one credit for each dollar paid in the present example. However, each player is given multiple pulls per credit regardless if the first and or previous pull was a winning combination. In this embodiment, one of the game information displays 19 may show the total amount of credits, the current number of pulls for the current credit being played, and the like. For example, the game information displays 19 may show that the player is on the $2^{nd}$ of 3 pulls for the credit being played.

It should be noted, that while the above embodiments may allow a player to receive multiple credits for each paid credit and or multiple plays/pulls for a single credit paid, the slot machine 10 may be programmed to keep the same and or similar payout schedule as current slot machines. Hence, while the above embodiments may appear to give players better odds at obtaining a payout, the slot machine 10 may be programmed to give the same and or similar payout schedule as present slot machine.

While embodiments of the disclosure have been described in terms of various specific embodiments, those skilled in the art will recognize that the embodiments of the disclosure can be practiced with modifications within the spirit and scope of the claims.

What is claimed is:

1. A slot machine comprising:

a wager receiving device to determine what currency is inserted into the slot machine; and a processor coupled to the wager receiving device, wherein the processor executes program instructions causing the processor to:

receive signals from the wager receiving device of the currency inserted into the slot machine;

calculating a number of credits based on the currency inserted into the slot machine; and providing one of the multiple said currency credits for each purchased credit; wherein, the each purchased credit provides plurality plays of said currency credit independent of a previous play or outcome.

2. A slot machine in accordance with claim 1, wherein the processor executes program instructions causing the processor to: provide at least 2 credits per credit paid.

3. A slot machine in accordance with claim 1, wherein the processor executes program instructions causing the processor to: provide at least 2 plays of the slot machine per credit paid regardless of outcome of a previous play.

4. A slot machine in accordance with claim 2, wherein the processor executes program instructions causing the processor to activate a playing area based on a number of credits selected by the player to play.

5. A slot machine in accordance with claim 2, wherein the processor executes program instructions causing the processor to:

activating a playing area for a first round based on a present credit played; and activating the playing area for a second round based on the present credit played, the processor activating the playing area for the second round regardless of the outcome of the first round.

6. A slot machine in accordance with claim 1, wherein the processor executes program instructions causing the processor to: read data from a card reading device of the slot machine and determining the number of credits based on the date read from the card reading device.

7. A slot machine comprising:

a wager receiving device to determine what currency is inserted into the slot machine; and a processor coupled to the wager receiving device, wherein the processor executes program instructions causing the processor to:

receive signals from the wager receiving device of the currency inserted into the slot machine;

calculating a number of credits based on the currency inserted into the slot machine; and providing one of the multiple said currency credits for each purchased credit; wherein, the each purchased credit provides plurality plays of said currency credit independent of a previous play or outcome.

8. A slot machine in accordance with claim 7, wherein the processor executes program instructions causing the processor to: provide at least 2 credits per credit paid.

9. A slot machine in accordance with claim 7, wherein the processor executes program instructions causing the processor to activate a playing area based on a number of credits selected by the player to play.

10. A slot machine in accordance with claim 1, wherein the processor executes program instructions causing the processor to: read data from a card reading device of the slot machine and determining the number of credits based on the date read from the card reading device.

11. A slot machine comprising:

a wager receiving device to determine what currency is inserted into the slot machine; and a processor coupled to the wager receiving device, wherein the processor executes program instructions causing the processor to:

receive signals from the wager receiving device of the currency inserted into the slot machine;

calculating a number of credits based on the currency inserted into the slot machine; and providing one of the multiple said currency credits for each purchased credit; wherein, the each purchased credit provides plurality plays of said currency credit independent of a previous play or outcome.

12. A slot machine in accordance with claim 11, wherein the processor executes program instructions causing the processor to: provide at least 2 plays of the slot machine per credit paid regardless of outcome of a previous play.

13. A slot machine in accordance with claim 12, wherein the processor executes program instructions causing the processor to activate a playing area based on a number of credits selected by the player to play.

14. A slot machine in accordance with claim 12, wherein the processor executes program instructions causing the processor to:

activating a playing area for a first round based on a present credit played; and activating the playing area for a second round based on the present credit played, the processor activating the playing area for the second round regardless of the outcome of the first round.

15. A slot machine in accordance with claim 11, wherein the processor executes program instructions causing the processor to: read data from a card reading device of the slot machine and determining the number of credits based on the date read from the card reading device.

* * * * *